US012678854B2

(12) United States Patent
Nishida et al.

(10) Patent No.: US 12,678,854 B2
(45) Date of Patent: Jul. 14, 2026

(54) SYSTEM FOR DETERMINING SET TEMPERATURE OF MOLTEN METAL

(71) Applicants: SINTOKOGIO, LTD., Nagoya (JP); Fujiwa Denki Co., Ltd., Oharucho Ama-gun (JP)

(72) Inventors: Tadashi Nishida, Oharucho Ama-gun (JP); Toshiyuki Hyodo, Oharucho Ama-gun (JP); Masanori Hoshino, Oharucho Ama-gun (JP)

(73) Assignees: SINTOKOGIO, LTD., Nagoya (JP); Fujiwa Denki Co., Ltd., Oharucho Ama-gun (JP)

( * ) Notice: Subject to any disclaimer, the term of this patent is extended or adjusted under 35 U.S.C. 154(b) by 557 days.

(21) Appl. No.: 18/215,206

(22) Filed: Jun. 28, 2023

(65) Prior Publication Data

US 2024/0009729 A1 Jan. 11, 2024

(30) Foreign Application Priority Data

Jul. 8, 2022 (JP) ..... 2022-110394

(51) Int. Cl.
*B22D 2/00* (2006.01)
*B22D 41/12* (2006.01)
(Continued)

(52) U.S. Cl.
CPC ..... *B22D 2/006* (2013.01); *B22D 41/12* (2013.01); *B22D 41/50* (2013.01); *B22D 47/02* (2013.01)

(58) Field of Classification Search
CPC ..... B22D 2/006; B22D 41/12; B22D 41/50; B22D 47/02
See application file for complete search history.

(56) References Cited

U.S. PATENT DOCUMENTS

2017/0209921 A1 7/2017 Nishida et al.
2017/0232507 A1 8/2017 Nishida et al.
(Continued)

FOREIGN PATENT DOCUMENTS

EP 1752726 A1 2/2007
JP H05-277709 A 10/1993
(Continued)

*Primary Examiner* — Kevin E Yoon
(74) *Attorney, Agent, or Firm* — Faegre Drinker Biddle & Reath LLP

(57) ABSTRACT

A system for determining a set temperature of molten metal in a pouring facility includes a temperature sensor configured to detect a molten metal temperature at a nozzle tip of a ladle during pouring processing, and a control unit configured to acquire temperature transition obtained by plotting the molten metal temperature for each mold in each of the pouring processing, wherein the control unit determines the upper limit temperature to cause a percentage of the number of optimum temperature transitions included in a plurality of acquired temperature transitions in the number of the plurality of acquired temperature transitions to become a predetermined percentage, and determines a temperature obtained by adding a drop temperature that is a temperature dropped during conveyance processing and the determined upper limit temperature, as the set temperature.

6 Claims, 10 Drawing Sheets

(51) Int. Cl.
*B22D 41/50* (2006.01)
*B22D 47/02* (2006.01)

(56) References Cited

U.S. PATENT DOCUMENTS

| | | | |
|---|---|---|---|
| 2019/0247917 | A1 | 8/2019 | Nishida et al. |
| 2021/0187606 | A1 | 6/2021 | Nishida et al. |

FOREIGN PATENT DOCUMENTS

| | | | | |
|---|---|---|---|---|
| JP | H08-197234 | A | 8/1996 | |
| JP | 2002-103023 | A | 4/2002 | |
| JP | 2014-034058 | A | 2/2014 | |
| JP | 5959564 | B2 | 8/2016 | |
| JP | 6427585 | B2 | 11/2018 | |
| JP | 6472899 | B2 | 2/2019 | |
| JP | 2021-102213 | A | 7/2021 | |
| KR | 101499753 | B1 | 3/2015 | |
| WO | WO-2014024955 | A1 * | 2/2014 | ..... G01K 1/02 |
| WO | 2014/057696 | A1 | 4/2014 | |

* cited by examiner

| CASTING NUMBER | MOLTEN METAL TEMPERATURE (℃) |
|---|---|
| 1 | 1417 |
| 2 | 1412 |
| 3 | 1413 |
| ⋮ | ⋮ |

| CASTING NUMBER | MOLTEN METAL TEMPERATURE (℃) |
|---|---|
| 1 | 1420 |
| 2 | 1426 |
| 3 | 1423 |
| ⋮ | ⋮ |

| CASTING NUMBER | MOLTEN METAL TEMPERATURE (℃) |
|---|---|
| 1 | 1300 |
| 2 | 1295 |
| 3 | 1285 |
| ⋮ | ⋮ |

| CASTING NUMBER | MOLTEN METAL TEMPERATURE (℃) |
|---|---|
| 1 | 1320 |
| 2 | 1315 |
| 3 | 1300 |
| ⋮ | ⋮ |

SYSTEM FOR DETERMINING SET TEMPERATURE OF MOLTEN METAL

CROSS-REFERENCE TO RELATED APPLICATION

This application is based on Japanese Patent Application No. 2022-110394 filed with Japan Patent Office on Jul. 8, 2022, the entire contents of which are hereby incorporated by reference.

TECHNICAL FIELD

The present disclosure relates to a system for determining a set temperature of molten metal.

BACKGROUND

Japanese Patent No. 6472899 discloses a pouring facility. The pouring facility includes a melting furnace generating molten metal of a set temperature. A ladle receives the molten metal generated by the melting furnace. The ladle having received the molten metal is conveyed to a pouring machine. The pouring machine sequentially pours the molten metal in the ladle into a plurality of molds. The pouring facility repeatedly performs a series of processing from receiving to pouring of the molten metal.

SUMMARY

In a case where a temperature of the molten metal in pouring is low, a failure such as misrun may occur. In the pouring facility disclosed in Japanese Patent No. 6472899, the set temperature of the molten metal in the melting furnace may be set higher than necessary, in order to avoid the failure. The present disclosure provides a system that can determine the set temperature of the molten metal in consideration of energy efficiency.

A system according to one aspect of the present disclosure determines a set temperature of molten metal in a pouring facility. The pouring facility repeats a series of processing including receiving processing for causing a ladle to receive the molten metal generated by a melting furnace generating the molten metal of the set temperature, conveyance processing for conveying the ladle to a pouring machine, and pouring processing for sequentially pouring the molten metal in the ladle to a plurality of molds by the pouring machine. The system includes a temperature sensor and a control unit. The temperature sensor is configured to detect a molten metal temperature at a nozzle tip of the ladle during the pouring processing. The control unit is configured to acquire a temperature transition obtained by plotting the molten metal temperature detected by the temperature sensor for each mold in each of the pouring processing. The control unit determines the temperature transition falling within a temperature range determined by an upper limit temperature and a predetermined lower limit temperature, as an optimum temperature transition, determines the upper limit temperature to cause a percentage of the number of optimum temperature transitions included in a plurality of acquired temperature transitions in the number of the plurality of acquired temperature transitions to become a predetermined percentage, and determines a temperature obtained by adding a drop temperature that is a temperature dropped during the conveyance processing and the determined upper limit temperature, as the set temperature.

According to the present disclosure, there is provided a technique to determine the set temperature of the molten metal in consideration of energy efficiency.

DETAILED DESCRIPTION

Outline of Embodiment of Present Disclosure

Figure 1:
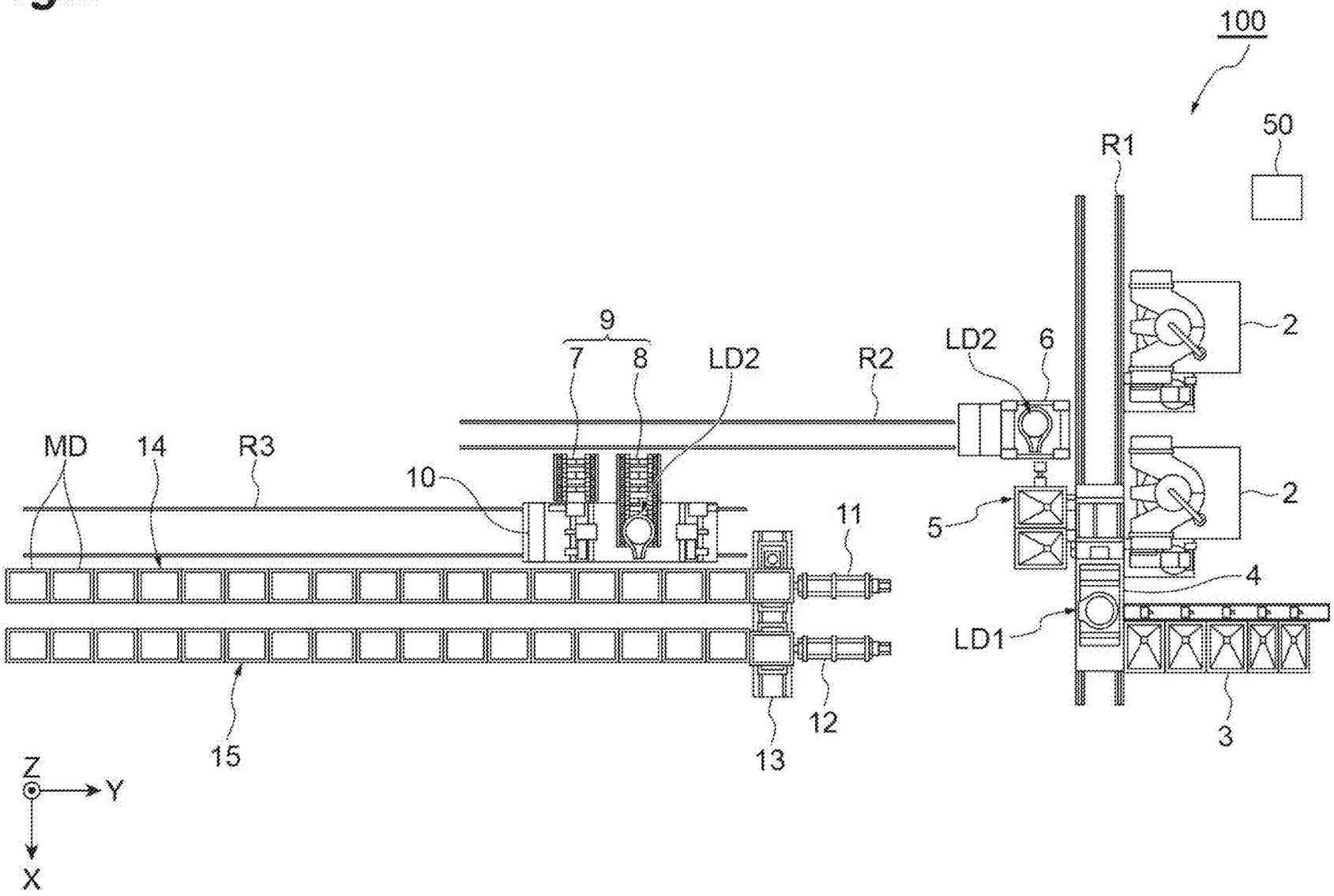
FIG. 1 is a plan view illustrating a part of a casting facility to which a set temperature determination system according to an exemplary embodiment is applied.

First, outline of an embodiment according to the present disclosure is described.

(Clause 1)

A system according to one aspect of the present disclosure determines a set temperature of molten metal in a pouring facility. The pouring facility repeats a series of processing including receiving processing for causing a ladle to receive the molten metal generated by a melting furnace generating the molten metal of the set temperature, conveyance processing for conveying the ladle to a pouring machine, and pouring processing for sequentially pouring the molten metal in the ladle into a plurality of molds by the pouring machine. The system includes a temperature sensor and a control unit. The temperature sensor is configured to detect a molten metal temperature at a nozzle tip of the ladle during the pouring processing. The control unit is configured to acquire a temperature transition obtained by plotting the molten metal temperature detected by the temperature sensor for each mold in each of the pouring processing. The control unit determines the temperature transition falling within a temperature range determined by an upper limit temperature and a predetermined lower limit temperature, as an optimum temperature transition, determines the upper limit temperature to cause a percentage of the number of optimum temperature transitions included in a plurality of acquired temperature transitions in the number of the plurality of acquired temperature transitions to become a predetermined percentage, and determines a temperature obtained by adding a drop temperature that is a temperature dropped during the conveyance processing and the determined upper limit temperature, as the set temperature.

In this system, the pouring processing for sequentially pouring the molten metal from the ladle to the plurality of molds is performed. When the ladle becomes empty, next pouring processing for sequentially pouring the molten metal from the next ladle into the plurality of molds is performed. Further, the temperature transition obtained by plotting the molten metal temperature detected by the temperature sensor for each mold is acquired in each of the pouring processing. The upper limit temperature is determined such that the percentage of the number of optimum temperature transitions included in the plurality of acquired temperature transitions in the number of the plurality of acquired temperature transitions becomes the predetermined percentage. The optimum temperature transition is a temperature transition falling within the temperature range determined by the upper limit temperature and the predetermined lower limit temperature. The temperature obtained by adding the drop temperature that is a temperature dropped during the conveyance processing and the determined upper limit temperature is determined as the set temperature.

In the above-described manner, the set temperature is determined, and the determined set temperature may be adopted as the next set temperature of the molten metal. The upper limit temperature used to determine the set temperature is determined such that the percentage of the number of optimum temperature transitions included in the plurality of temperature transitions in the number of the plurality of temperature transitions becomes the predetermined percentage (for example, 60 percent to 80 percent). Therefore, the system can avoid the set temperature of the molten metal in the melting furnace from being set higher than necessary. Accordingly, the system can determine the set temperature of the molten metal in consideration of energy efficiency.

(Clause 2)

In the system described in clause 1, the control unit may select, among the temperature transitions of the pouring processing, temperature transitions of the pouring processing using a mold same as a pattern used in the pouring processing corresponding to the acquired temperature transitions, determine the upper limit temperature to cause the temperature transitions corresponding to the predetermined percentage among the selected temperature transitions of the pouring processing to be the optimum temperature transitions, and determine a temperature obtained by adding the drop temperature and the determined upper limit temperature, as the set temperature corresponding to the pattern. In this case, the system can determine an optimum set temperature of the molten metal for each pattern.

(Clause 3)

In the system described in clause 1 or 2, in a case where the temperature transition includes a molten metal temperature less than the lower limit temperature, the control unit may determine the upper limit temperature again. In this case, in a case where a failure is likely to occur, the system can determine the set temperature again by reviewing the upper limit temperature while avoiding the set temperature of the molten metal in the melting furnace from being set higher than necessary.

(Clause 4)

The system described in any one of clauses 1 to 3 may include a display apparatus configured to display information about the melting furnace. In a case where a difference between the molten metal temperature of a first mold included in the acquired temperature transition and the upper limit temperature is not within a preset range, the control unit may display information about the difference on the display apparatus. In this case, the system can notify change in drop temperature to, for example, a worker of the melting furnace through the display apparatus.

(Clause 5)

The system described in any of clauses 1 to 4 may include a display apparatus configured to display information about the melting furnace. The control unit may display the molten metal temperature of a last mold included in the acquired temperature transition on the display apparatus. The temperature of the molten metal poured into the last mold in the pouring processing is the lowest in the pouring processing. The lowest temperature in the pouring processing is displayed on the display apparatus, which enables the worker to monitor the lowest temperature and to determine whether a failure is likely to occur.

(Clause 6)

A system according to another aspect of the present disclosure determines a set temperature of molten metal in a pouring facility. The pouring facility repeats a series of processing including receiving processing for causing a ladle to receive the molten metal generated by a melting furnace generating the molten metal of the set temperature, conveyance processing for conveying the ladle to a pouring machine, and pouring processing for sequentially pouring the molten metal in the ladle into a plurality of molds by the pouring machine. The system includes a temperature sensor and a control unit. The temperature sensor is configured to detect a molten metal temperature at a nozzle tip of the ladle during the pouring processing. The control unit is configured to acquire a temperature transition obtained by plotting the molten metal temperature detected by the temperature sensor for each mold in each of the pouring processing, and determines the set temperature. In a case where the temperature transition falling within a temperature range determined by an upper limit temperature and a predetermined lower limit temperature is determined as an optimum temperature transition, the set temperature determined by the control unit satisfies relationship in which a temperature obtained by adding the upper limit temperature and a drop temperature becomes the set temperature. The upper limit temperature is determined to cause a percentage of the number of optimum temperature transitions included in a plurality of acquired temperature transitions in the number of the plurality of acquired temperature transitions to become a predetermined percentage. The drop temperature is a temperature dropped during the conveyance processing. The system achieves the effects same as the effects by the system described in clause 1.

Exemplification of Embodiment of Present Disclosure

An exemplary embodiment of the present disclosure is described below with reference to drawings. In the following description, the same or equivalent elements are denoted by the same reference numerals, and redundant description is not repeated.

[Outline of Casting Facility]

FIG. 1 is a plan view illustrating a part of a casting facility to which a set temperature determination system according to the exemplary embodiment is applied. A casting facility 100 illustrated in FIG. 1 taps a part of original molten metal obtained in a melting furnace to a ladle, conveys the ladle storing the molten metal to a pouring machine, and pours the molten metal in the conveyed ladle into molds by using the pouring machine. As illustrated in FIG. 1, as an example, the casting facility 100 includes melting furnaces 2. The melting furnaces 2 melt melting materials with heat to obtain original molten metal. One or a plurality of melting furnaces 2 may be installed. In the example of FIG. 1, two melting furnaces 2 are installed side by side. A corresponding melting material charging apparatus is installed in parallel to each of the melting furnaces 2, and the melting materials are charged into the furnaces by the melting material charging apparatuses. The melting furnaces 2 can obtain the original molten metal in an amount sufficient to be tapped to a receiving ladle described below a plurality of times.

The melting furnaces 2 generate the original molten metal of a set temperature. The set temperature is a target temperature of the original molten metal. The set temperature may be set, for example, for each pattern. A worker refers to information about the set temperature displayed on a display apparatus 50 provided near the melting furnaces 2, and controls output of the melting furnaces 2 to adjust the temperature of the original molten metal to the set temperature. The set temperature determination system according to the exemplary embodiment is a system for determining the set temperature.

The molten metal obtained by the melting furnaces 2 is tapped into a processing ladle LD1. The processing ladle LD1 cures the molten metal and transports the molten metal to a next process. The processing ladle LD1 is placed on a receiving bogie 4. The receiving bogie 4 moves on receiving bogie rails R1. Before receiving the molten metal, the receiving bogie 4 moves to a position of a primary inoculation apparatus 3 in order to adjust components of the original molten metal. A material to adjust the components of the original molten metal is charged into the processing ladle LD1 by the primary inoculation apparatus 3. Thereafter, the receiving bogie 4 moves to a receiving position, and the molten metal is tapped from the melting furnaces 2 into the processing ladle LD1. The receiving bogie 4 moves to a transfer position, and the molten metal in the processing ladle LD1 is transferred to a pouring ladle LD2 (example of receiving processing). Transfer indicates transfer of the molten metal in a ladle to another ladle. When the molten metal is transferred from the processing ladle LD1 to the pouring ladle L2, an inoculant is charged into the pouring ladle LD2 by a secondary inoculation apparatus 5, and the components of the molten metal are adjusted.

The pouring ladle LD2 is placed on a conveyance bogie 6, and is conveyed along conveyance bogie rails R2. The conveyance bogie 6 can be stopped at a ladle replacement position where the pouring ladle L2 is conveyed to a pouring machine 10, in addition to the above-described transfer position.

The pouring ladle LD2 is conveyed along the conveyance bogie rails R2, and reaches a pouring facility (example of conveyance processing). In the pouring facility, the molten metal is poured into molds MD. The pouring ladle LD2 (filled ladle) filled with the molten metal is delivered from the conveyance bogie 6 to a ladle replacement apparatus 9 on a previous stage (ladle replacement position) of the pouring machine 10. The ladle replacement apparatus 9 replaces the filled ladle with the pouring ladle LD2 (empty ladle) that is empty after pouring. For example, the pouring machine 10 slides to replace the filled ladle and the empty ladle. For example, when the pouring machine 10 slides to a front side of a roller conveyor 8, the empty ladle is delivered from the pouring machine 10 to the roller conveyor 8. When the pouring machine 10 slides to a front side of a roller conveyor 7, the filled ladle is delivered from the roller conveyor 7 to the pouring machine 10.

The pouring machine 10 pours the molten metal stored in the pouring ladle LD2, into the molds MD (example of pouring processing). The pouring machine 10 is provided lateral to a pouring zone 14. In the pouring zone 14, a mold conveyance apparatus arranges the plurality of molds MD formed by a molding machine (not illustrated), in line, and conveys the molds MD one by one. The pouring machine 10 sequentially pours the molten metal in the pouring ladle LD2, into the conveyed molds MD in the pouring zone 14.

In the pouring zone 14, rails for the molds are laid, and paired mold indexing apparatuses 11 (pusher and cushion) configuring a mold conveyance apparatus are disposed at both ends of the rails. The pusher configuring one of the mold indexing apparatuses 11 has a function of pushing the molds MD, and the cushion configuring the other mold indexing apparatus 11 has a function of receiving the pushed molds MD. The molds MD can be fed without any gap by the pusher and the cushion. The mold indexing apparatuses 11 feed the molds MD one by one. In FIG. 1, only the mold indexing apparatus (cushion) at front ends of the rails is illustrated, and illustration of the mold indexing apparatus (pusher) disposed at rear ends of the rails is omitted.

In the pouring zone 14, pouring rails R3 for the pouring machine are laid. The pouring rails R3 are laid along the rails for the molds. The pouring machine 10 can be mounted with the pouring ladle LD2, and move along the pouring rails R3. The pouring machine 10 moves to an optional position on the pouring rails R3, tilts the pouring ladle LD2, and pours the molten metal into each mold MID.

When each mold MID reaches the front ends of the rails in the pouring zone 14, the mold MID is moved to an adjacent cooling zone 15 by a traverser 13. In the cooling zone, the mold ID is conveyed to a mold shakeout apparatus (not illustrated) while a product after pouring is cooled inside the mold MID. In the cooling zone 15, rails for the molds MID are laid, and paired mold indexing apparatuses 12 (pusher and cushion) are disposed at both ends of the rails, as in the pouring zone 14. In FIG. 1, only the mold indexing apparatus (pusher) at rear ends of the rails is illustrated, and illustration of the mold indexing apparatus (cushion) disposed at front ends of the rails is omitted. Operation of the mold indexing apparatuses 12 is the same as the operation of the mold indexing apparatuses 11. The molds MD in the cooling zone 15 are conveyed by the mold indexing apparatuses 12 in a direction opposite to a conveyance direction of the molds MD in the pouring zone 14. The molds MD after pouring are cooled on the rails over time, and the molten metal is solidified and turned into a casting before reaching the mold shakeout apparatus.

As described above, in the casting facility 100, a series of processing including the receiving processing for causing the pouring ladle LD2 to receive the molten metal generated by the melting furnaces 2 generating the molten metal of the set temperature, the conveyance processing for conveying the pouring ladle LD2 to the pouring machine 10, and the pouring processing for sequentially pouring the molten metal in the pouring ladle LD2, into the plurality of molds MD by the pouring machine 10 is repeatedly performed.

[Details of Receiving Bogie]

Figure 2:
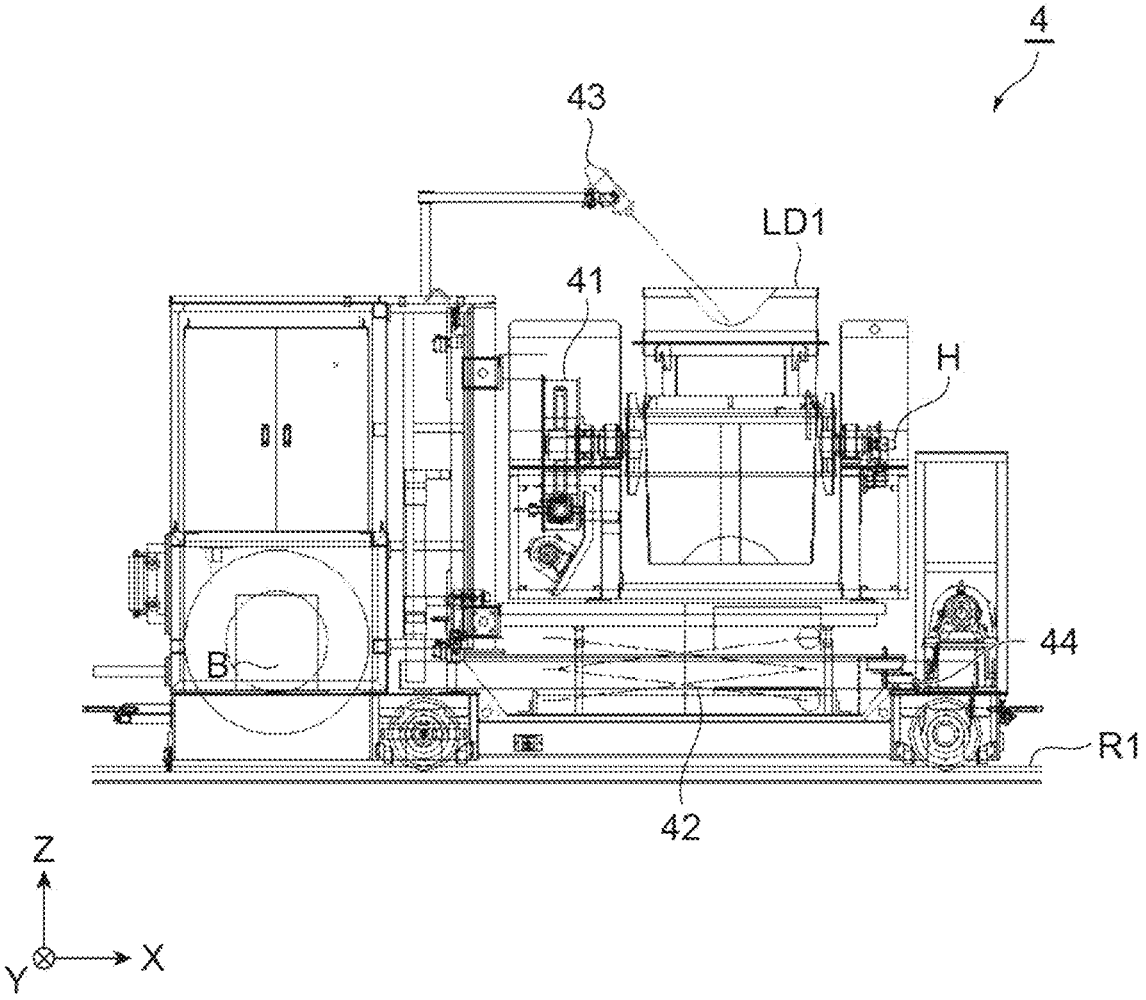
FIG. 2 is a side view illustrating an example of a receiving bogie.

FIG. 2 is a side view illustrating an example of the receiving bogie. As illustrated in FIG. 2, the receiving bogie 4 is mounted with the processing ladle LD1, and runs along the receiving bogie rails R1. Therefore, the receiving bogie 4 can move to a position where the material is charged by the primary inoculation apparatus 3, a position where the molten metal is received from the melting furnaces 2, and a position where the molten metal is transferred from the processing ladle LD1 to the pouring ladle LD2. The receiving bogie 4 includes a transfer mechanism 41 tiltably supporting the processing ladle LD1. The transfer mechanism 41 tilts the processing ladle LD1 around a tilt shaft H extending in an X direction in the drawing. The receiving bogie 4 further includes a vertically moving mechanism 42 vertically movably supporting the processing ladle LD1. As a result, the processing ladle LD1 can transfer the molten metal from a predetermined height.

The receiving bogie 4 includes a non-contact first temperature sensor 43 measuring the temperature of the received molten metal (receiving temperature). The first temperature sensor 43 calculates the temperature of the molten metal by using, for example, a two-color infrared radiation amount detected by a sensor head of a two-color pyrometer.

The receiving bogie 4 includes a first load cell 44 detecting a weight of the processing ladle LD1. The first load cell 44 is provided in, for example, a member supporting the processing ladle LD1.

[Details of Pouring Machine]

Figure 3:
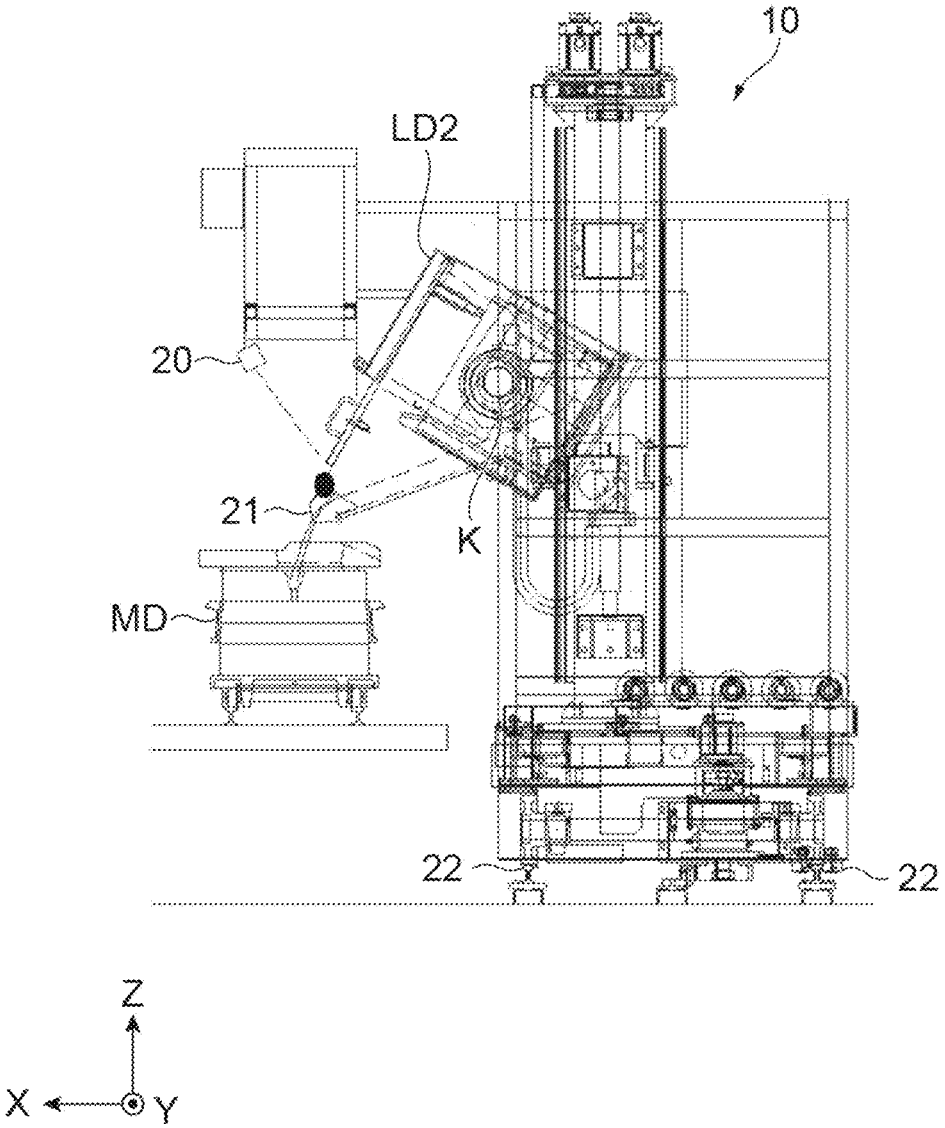
FIG. 3 is a front view illustrating an example of a pouring machine.
Figure 4:
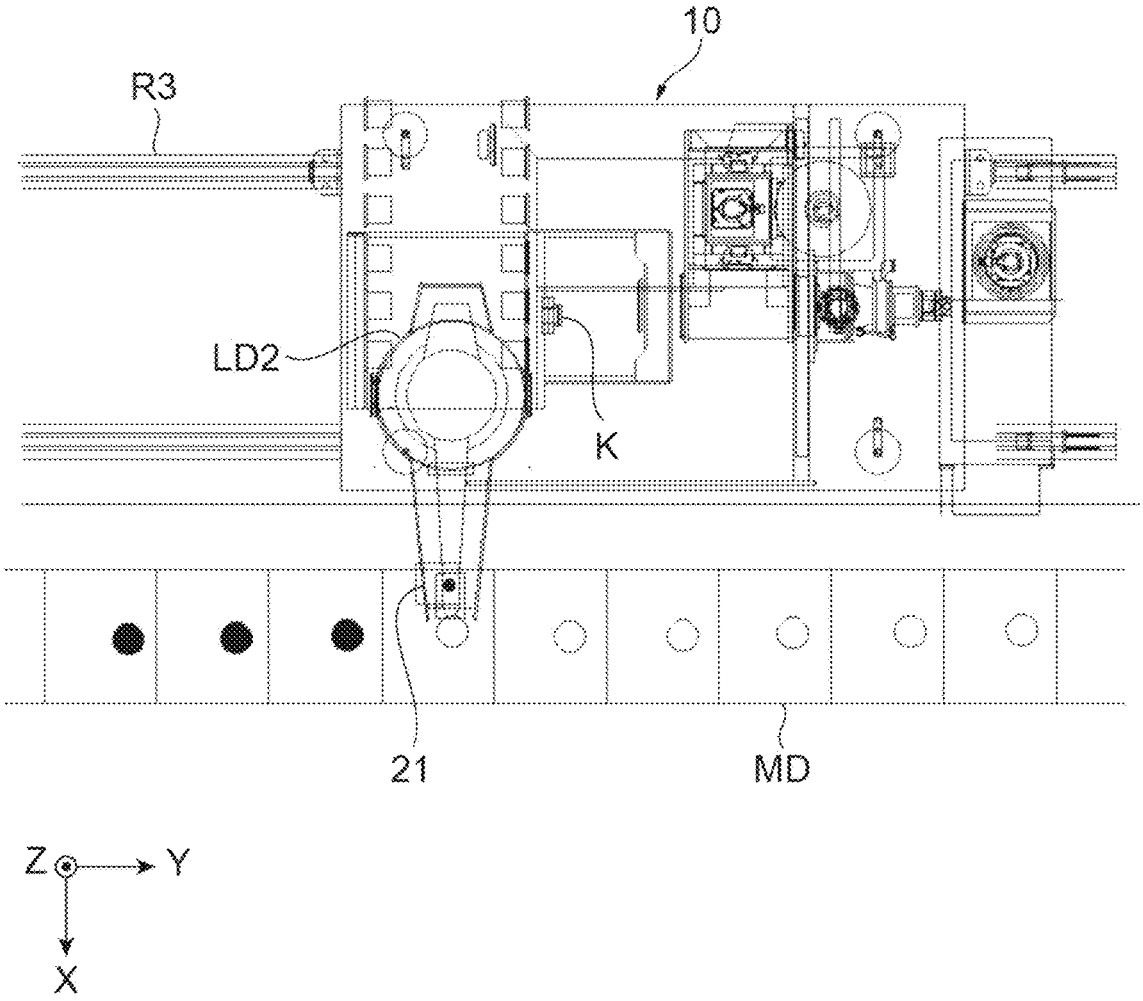
FIG. 4 is a top view illustrating an example of the pouring machine.

FIG. 3 is a front view illustrating an example of the pouring machine. FIG. 4 is a top view illustrating an example of the pouring machine. As illustrated in FIG. 3 and FIG. 4, the pouring machine 10 is mounted with the pouring ladle LD2, and runs along the pouring rails R3. As a result, the pouring ladle LD2 can move along the line of the molds. Further, the pouring machine 10 tiltably supports the pouring ladle LD2. The pouring machine 10 tilts the pouring ladle LD2 around a tilt shaft K extending in a Y direction in the drawings. Further, the pouring machine 10 supports the pouring ladle LD2 to be vertically movable and movable in a front-rear direction. As a result, the pouring ladle LD2 can pour the molten metal from a predetermined position and a predetermined height.

The pouring machine 10 includes a non-contact second temperature sensor 20 (example of temperature sensor) measuring the temperature of the molten metal to be poured. The second temperature sensor 20 calculates the temperature of the molten metal by using, for example, a two-color infrared radiation amount detected by a sensor head of a two-color pyrometer. A position measured by the second temperature sensor 20 is set to a nozzle tip 21 that is a tap port of a nozzle of the pouring ladle LD2. As a result, the second temperature sensor 20 can measure a temperature of a stream of the molten metal.

The pouring machine 10 includes a second load cell 22 detecting a weight of the pouring ladle LD2. The second load cell 22 is provided in, for example, a member supporting the pouring ladle LD2.

[Outline of Set Temperature Determination System]

Figure 5:
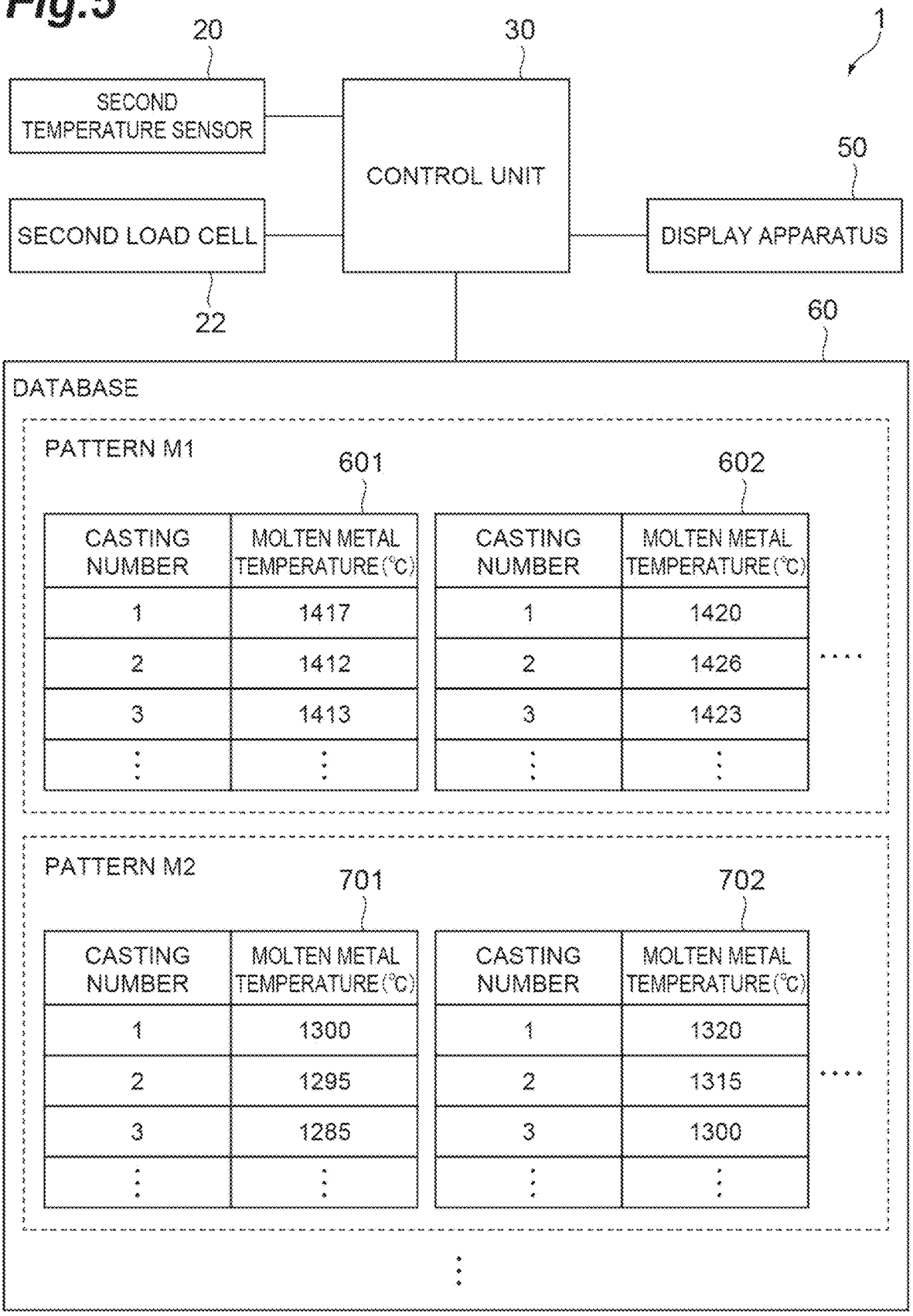
FIG. 5 is a block diagram illustrating an example of the set temperature determination system according to the exemplary embodiment.

FIG. 5 is a block diagram illustrating an example of the set temperature determination system according to the exemplary embodiment. A set temperature determination system 1 illustrated in FIG. 5 includes the second temperature sensor 20 and a control unit 30. As described above, the second temperature sensor 20 is a device detecting the molten metal temperature at the nozzle tip 21 of the pouring ladle LD2 during the pouring processing. The second temperature sensor 20 outputs a detection result to the control unit 30.

The control unit 30 is a controller totally controlling the set temperature determination system 1. The control unit 30 is configured as, for example, a programmable logic controller (PLC). The control unit 30 may be configured as a computer system that includes a processor such as a central processing unit (CPU), a memory such as a random access memory (RAM) and a read only memory (ROM), an input/output device such as a touch panel, a mouse, a keyboard, and a display, and a communication device such as a network card. The control unit 30 realizes functions of the control unit 30 by operating each piece of hardware under the control of the processor based on computer programs stored in the memory.

(Acquisition of Temperature Transition by Control Unit)

The control unit 30 acquires a temperature transition obtained by plotting the molten metal temperature detected by the second temperature sensor 20 for each mold, in each pouring processing. The pouring processing indicates that the molten metal in one pouring ladle LD2 is poured into the plurality of molds MD. The pouring processing starts when the pouring ladle LD2 conveyed to the pouring machine 10 pours the molten metal into a first mold MD, and ends when the molten metal in the pouring ladle LD2 becomes less than or equal to a predetermined amount due to sequential pouring into subsequent molds MD, or when pouring of the molten metal into the assigned number of molds MD is completed. In other words, one pouring processing corresponds to one pouring ladle LD2. The control unit 30 acquires the temperature transition obtained by plotting the molten metal temperature detected by the second temperature sensor 20 for each mold, in each pouring processing, namely, for each pouring ladle LD2. The temperature transition indicates relationship between the molten metal temperature and a casting number. The casting number is an identifier assigned to the mold into which the molten metal is poured. The temperature transition may indicate relationship between the molten metal temperature and time.

The control unit 30 may be connected to a database 60, and store the temperature transition for each pouring ladle LD2 in the database 60. For example, in a case where two pouring ladles LD2, namely, a first ladle L1 and a second ladle L2 are included, a temperature transition 601 of the molten metal in the first ladle L1 is stored, and a temperature transition 602 of the molten metal in the second ladle L2 is also stored. Note that the number of pouring ladles LD2 is not limited to two, and one or three or more pouring ladles LD2 may be provided. Since the series of processing by the casting facility 100 is repeatedly performed, the pouring ladle LD2 is repeatedly used. In other words, a plurality of temperature transitions of the same ladle may be stored. In this case, in the database 60, the temperature transitions of the same ladle may be distinguished and stored in association with the time, or may be incorporated in the same line by changing the number system of the casting numbers.

The control unit 30 may further store, for each pattern, the temperature transition for each pouring ladle LD2. This is because the set temperature is determined depending on the pattern. For example, in a case where two pouring ladles LD2, namely, the first ladle L1 and the second ladle L2 are included and two patterns, namely, a first pattern M1 and a second pattern M2 are used, not only the temperature transition 601 of the molten metal in the first ladle L1 and the temperature transition 602 of the molten metal in the second ladle L2 corresponding to the first pattern M1, but also a temperature transition 701 of the molten metal in the first ladle L1 and a temperature transition 702 of the molten metal in the second ladle L2 corresponding to the second pattern M2 are stored. Note that the number of patterns is not limited to two, and one or three or more patterns may be used.

Figure 6A:
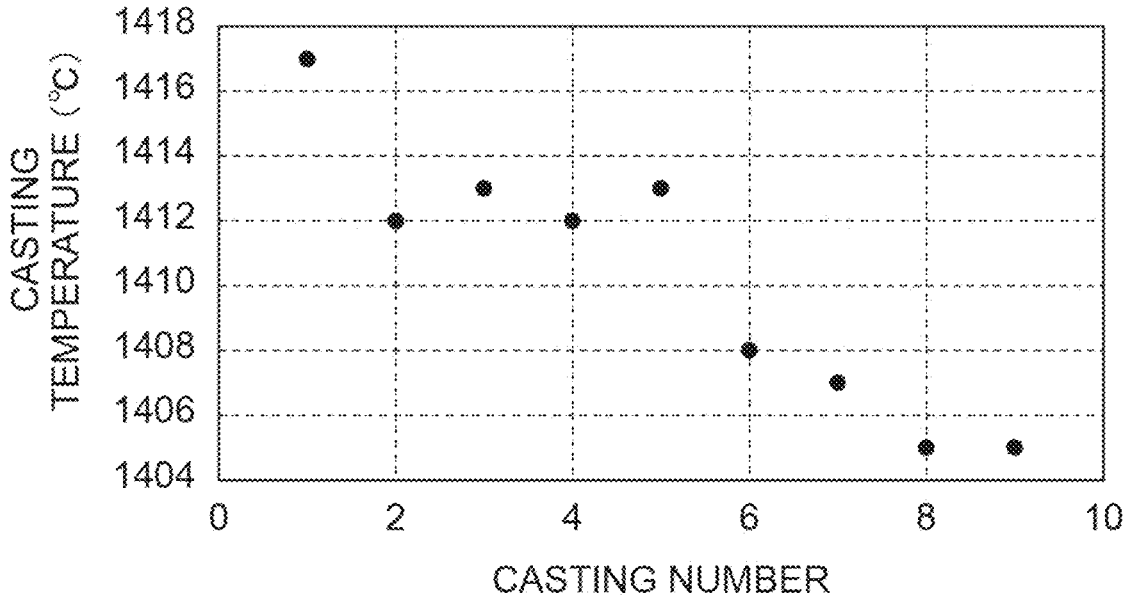
FIGS. 6A and 6B are graphs illustrating an example of transition of a casting temperature in each ladle.
Figure 6B:
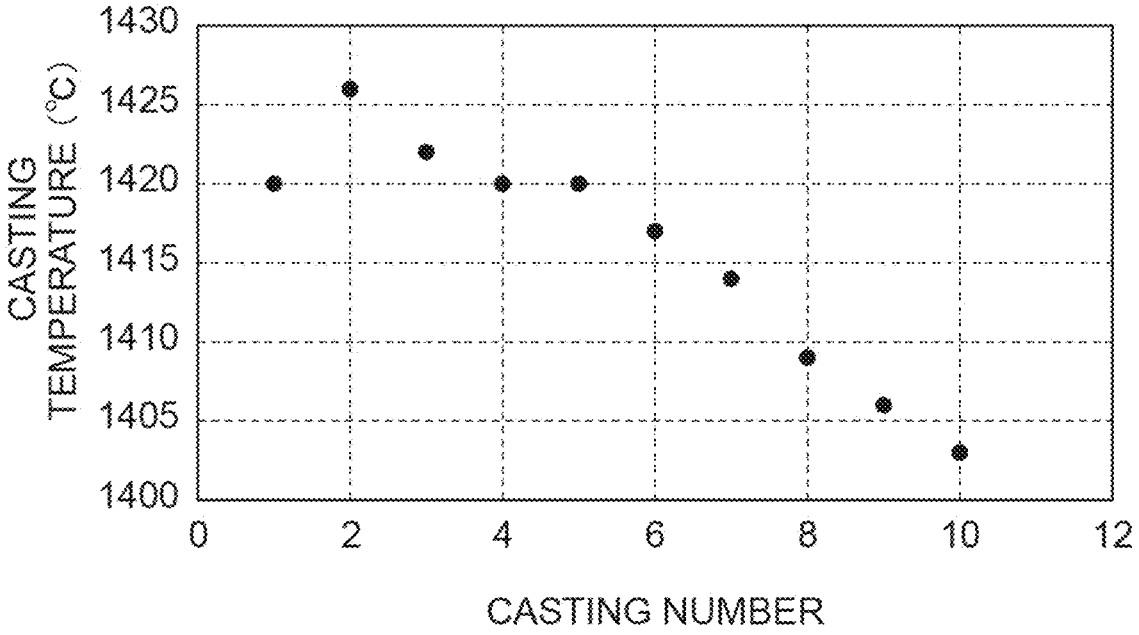

FIGS. 6A and 6B are graphs illustrating an example of a casting temperature transition for each ladle. The casting temperature is the molten metal temperature during the pouring processing. In the graph illustrated in FIG. 6A, an ordinate indicates the casting temperature of the first ladle L1 corresponding to the first pattern M1, and an abscissa indicates the casting number. In the graph illustrated in FIG. 6B, an ordinate indicates the casting temperature of the second ladle L2 corresponding to the first pattern M1, and an abscissa indicates the casting number. It is known from FIGS. 6A and 6B that initial casting temperatures (casting temperatures of casting number "1") are largely varied. Such a variation is caused by difference in temperature of the molten metal in the melting furnaces 2 and difference in a ladle conveyance state. The ladle conveyance state is substantially uniformized by adopting the casting facility 100 as illustrated in FIG. 1, causing the ladle to automatically run on the rails, and managing the time. Therefore, the variation is mainly caused by difference in temperature of the molten metal in the melting furnaces 2. To prevent occurrence of misrun if the variation occurs, the set temperature of the molten metal in the melting furnaces 2 may be set to a higher temperature. However, such countermeasures cause deterioration in energy efficiency.

(Determination of Set Temperature by Control Unit)

The control unit 30 determines the set temperature of the melting furnaces 2. The control unit 30 determines an optimum set temperature of the melting furnaces 2 to a temperature as low as possible within a range where a failure such as misrun does not occur, in order to achieve quality securement of a product and improvement of energy efficiency contradicting each other. When an operation mode is set to a mode for determining the set temperature (hereinafter, check mode), the control unit 30 determines the set temperature of the melting furnaces 2. The check mode is set, for example, in a case where the set temperature corresponding to the pattern is not previously stored or in a case where a failure such as misrun occurs. The check mode is a mode for analyzing the temperature transitions relating to the plurality of pouring ladles LD2 acquired in the mode. In the case where the operation mode is set to the check mode, the control unit 30 generates the molten metal at a previously assumed provisional set temperature, performs the pouring processing using a pattern, the set temperature of which is unknown, a plurality of times, thereby acquiring the plurality of temperature transitions. In a case where a set temperature of a pattern that is approximate in a casting weight and a casting design to the target pattern is present, the provisional set temperature may be the set temperature of the approximation pattern.

The control unit 30 acquires, as information on the pattern of the mold MD, a lower limit temperature Td corresponding to the pattern used in the pouring processing, from the molding machine (not illustrated). The lower limit temperature Td is a limit temperature at which it is previously confirmed that a failure such as misrun does not occur, and is different depending on a pattern. The control unit 30 confirms that the lowest temperature as a temperature lowest in the temperature transition is greater than or equal to the lower limit temperature Td in each temperature transition.

The control unit 30 determines the set temperature of the melting furnaces 2 based on the plurality of temperature transitions in which it is confirmed that the lowest temperature is greater than or equal to the lower limit temperature Td. To determine the optimum set temperature of the melting furnaces 2, the control unit 30 determines an upper limit temperature Tu during the pouring processing. The upper limit temperature Tu is the highest temperature of the molten metal temperature possible during the pouring processing. The molten metal temperature is dropped with time. Therefore, the upper limit temperature Tu is substantially a target value of the temperature of the molten metal poured into a first mold (mold MD).

The control unit 30 determines, among the plurality of temperature transitions, the temperature transition falling within a temperature range determined by the upper limit temperature Tu and the predetermined lower limit temperature Td, as the optimum temperature transition. The control unit 30 determines the upper limit temperature Tu such that a percentage of the number of optimum temperature transitions included in the plurality of acquired temperature transitions in the number of the plurality of acquired temperature transitions becomes a predetermined percentage. The predetermined percentage is set to a range of 60 percent to 80 percent as an example. The control unit 30 stores the determined upper limit temperature Tu and the pattern in the memory or the like in association with each other.

Figure 7:
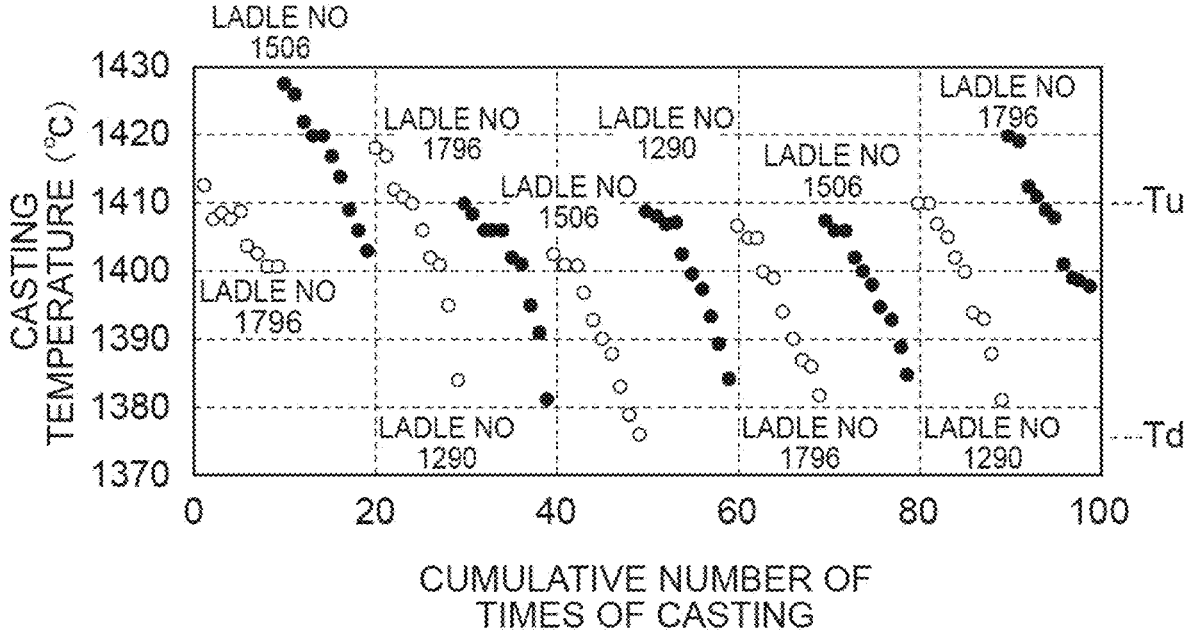
FIG. 7 is a graph illustrating relationship between the cumulative number of times of casting and the casting temperature.

FIG. 7 is a graph illustrating relationship between the cumulative number of times of casting and the casting temperature. FIG. 7 is the graph in a case where the operation mode is set to the check mode and the molten metal is poured by using the same pattern. In FIG. 7, an ordinate indicates the casting temperature (pouring temperature), and an abscissa indicates the cumulative number of times of casting. FIG. 7 illustrates the temperature transitions of the respective ladle numbers (ladle NOs). In this example, three pouring ladles having the ladle numbers "1796", "1506", and "1290" are used. The pouring ladles LD2 reach the pouring machine 10 in order of the ladle having the ladle NO "1796", the ladle having the ladle NO "1506", and the ladle having the ladle NO "1290", and the pouring ladles LD2 repeatedly reach in this order. To improve visibility, the pouring temperature of the pouring ladle odd-numbered in the reaching order is illustrated by an open data point, and the pouring temperature of the pouring ladle even-numbered in the reaching order is illustrated by a solid data point.

The control unit 30 grasps a first casting temperature in each of the temperature transitions greater than or equal to the lower limit temperature Td, among the temperature transitions. This is because the first casting temperature is generally the highest in each temperature transition. To obtain more accurate data, the control unit 30 may acquire the highest temperature in each of the temperature transitions greater than or equal to the lower limit temperature Td. In the example of FIG. 7, temperatures 1414° C., 1428° C., 1418° C., 1410° C., 1403° C., 1408° C., 1407° C., 1407° C., 1410° C., and 1420° C. are acquired in order. The control unit 30 sets the upper limit temperature Tu such that the temperatures corresponding to the predetermined percentage do not exceed the upper limit temperature Tu. In a case where the predetermined percentage is set to 60 percent, the control unit 30 selects six temperatures in ascending order among the above-described 10 casting temperatures (or highest temperatures), and sets a sixth temperature as the upper limit temperature Tu. In the example of FIG. 7, the upper limit temperature is set to 1410° C. As a result, six temperature transitions from a fourth temperature transition to a ninth temperature transition (cumulative number of times of casting is 40 to 90) are the optimum temperature transitions.

Note that the above-described method of determining the upper limit temperature Tu by the control unit 30 is an example. In the case where the predetermined percentage is set to 60 percent, the control unit 30 may select five temperatures in descending order among the above-described 10 casting temperatures (or highest temperatures), and set a fifth temperature as the upper limit temperature Tu. Alternatively, the control unit 30 may create a frequency distribution, and calculate the upper limit temperature Tu satisfying the predetermined percentage. Further, in a case where the number of the plurality of temperature transitions is not coincident with the predetermined percentage, for example, in a case where the predetermined percentage is 60 percent but the number of temperature transitions is indivisible, the upper limit temperature Tu is determined such that the percentage becomes closest to the predetermined percentage. Alternatively, the upper limit temperature Tu may be determined such that the percentage becomes greater than or equal to the predetermined percentage and closest to the predetermined percentage. Such a case is also included in an aspect in which the upper limit temperature is determined "such that the percentage becomes the predetermined percentage".

The control unit 30 determines the set temperature of the melting furnaces 2 in consideration of temperature drop of the molten metal during the conveyance processing such that the temperature of the molten metal becomes the upper limit temperature Tu at a time when the pouring ladle LD2 reaches the pouring machine 10. A drop temperature of the molten metal during the conveyance processing is a temperature dropped with time necessary for the conveyance processing, is previously acquired for each pattern in a drop check mode describe below, and is stored in the memory or the like. The control unit 30 acquires the drop temperature corresponding to the pattern by referring to the memory.

The control unit 30 determines a temperature obtained by adding the upper limit temperature Tu and the drop temperature corresponding to the pattern, as the set temperature. Further, the control unit 30 stores the pattern and the set temperature in the memory or the like in association with each other. As a result, in a case where the molten metal is poured into the molds of the same pattern, the control unit 30 can determine the set temperature of the melting furnaces 2 by referring to the memory without performing the check mode. The control unit 30 displays information about the melting furnaces, for example, the set temperature on the display apparatus 50. The worker checks the set temperature and adjusts the temperature of the original molten metal in the melting furnaces 2. Therefore, the set temperature of the molten metal in the melting furnaces 2 is not set to the temperature higher than necessary, and the set temperature of the molten metal in consideration of energy efficiency is accordingly determined.

Note that the above-described method of determining the set temperature by the control unit 30 is an example. The control unit 30 may prepare a table in which relationship among the upper limit temperature Tu, the drop temperature, and the set temperature are previously defined, and receive the upper limit temperature Tu and the drop temperature as inputs to refer to the table, thereby determining the set temperature without actually adding the upper limit temperature Tu and the drop temperature. In other words, the internal processing of the control unit 30 may be determined in any manner as long as the control unit 30 receives the plurality of temperature transitions as input data and outputs the set temperature as output data, and the input data and the output data have predetermined relationship. More specifically, in a case where the temperature transition falling within the temperature range determined by the upper limit temperature and the predetermined lower limit temperature is the optimum temperature transition, it is sufficient for the set temperature determined by the control unit 30 to satisfy relationship in which the temperature obtained by adding the upper limit temperature determined such that the percentage of the number of optimum temperature transitions included in the plurality of acquired temperature transitions in the number of the plurality of acquired temperature transitions becomes the predetermined percentage, and the drop temperature that is the temperature dropped during the conveyance processing becomes the set temperature.

When the operation mode is set to the drop check mode, the control unit 30 determines the drop temperature. The drop check mode is set, for example, in a case where the drop temperature corresponding to the pattern is not previously stored, or in a case where a difference between an in-ladle temperature at start of pouring from the pouring ladle LD2 (molten metal temperature of first mold included in acquired temperature transition) and the upper limit temperature Tu is not within a preset range. The drop check mode is a mode for analyzing temperature data acquired in the mode. In the case where the operation mode is set to the drop check mode, the control unit 30 generates the molten metal at a previously assumed provisional set temperature, performs the pouring processing using a pattern, the drop temperature of which is unknown, a plurality of times, thereby acquiring the plurality of temperature transitions. The control unit 30 calculates differences between the receiving temperatures relating to the plurality of pouring ladles LD2 and the in-ladle temperatures at start of pouring from the respective pouring ladles LD2, and sets a moving average of the differences excluding an abnormal value (for example, 30° C.) as the drop temperature. Thereafter, the control unit 30 stores the pattern and the drop temperature in the memory or the like in association with each other. As a result, in the case where the molten metal is poured into the molds of the same pattern, the control unit 30 can determine the drop temperature by referring to the memory without performing the drop check mode. Note that the drop temperature in a standard ladle conveyance facility is about 30° C. to about 50° C. as an example.

The drop temperature and the upper limit temperature Tu may be varied depending on climate or a state of the molten metal. In a case where the difference between the molten metal temperature of the first mold included in the acquired temperature transition and the upper limit temperature Tu is not within the preset range during normal operation after the check mode ends, the control unit 30 may display information about the difference on the display apparatus 50. The preset range is an allowable error range, and is, for example, about ±2° C. The information about the difference is displayed on the display apparatus 50, which enables the worker of the melting furnaces 2 to operate the control unit 30 in the check mode or the drop check mode.

In a case where the pouring temperature is less than the lower limit temperature Td during the normal operation after the check mode ends, the control unit 30 cancels pouring from the pouring ladle LD2, and discharges the molten metal stored in the pouring ladle LD2 or returns the molten metal to the melting furnaces 2. The control unit 30 may display the molten metal temperature of a last mold included in the acquired temperature transition, on the display apparatus 50. As a result, the worker can monitor the lowest temperature in the temperature transition, and predict that the pouring temperature becomes less than the lower limit temperature Td.

(Operation of Pouring Machine)

Figure 8:
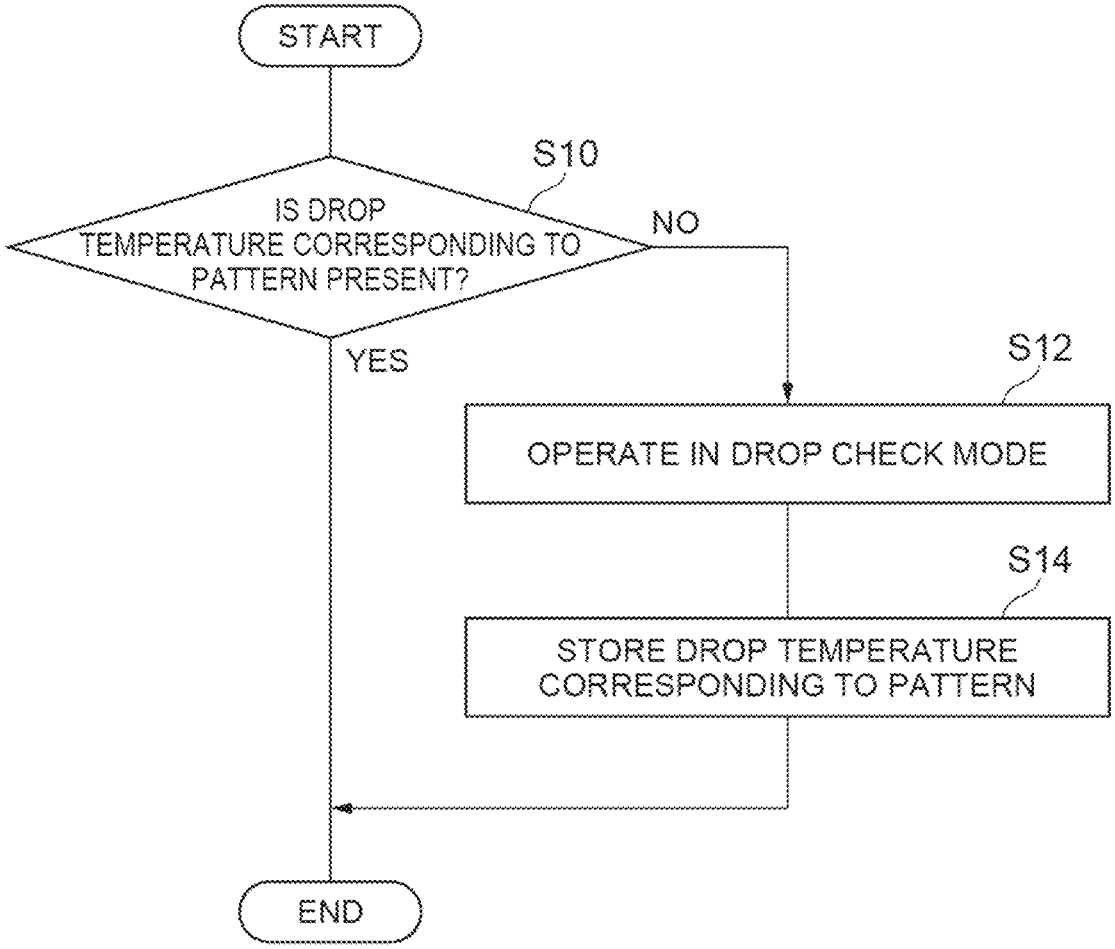
FIG. 8 is a flowchart illustrating an example of operation of the set temperature determination system according to the exemplary embodiment.

FIG. 8 is a flowchart illustrating an example of operation of the set temperature determination system according to the exemplary embodiment. The flowchart illustrated in FIG. 8 is performed before the pouring processing starts.

As illustrated in FIG. 8, the control unit 30 determines whether the drop temperature corresponding to the pattern has been stored in the memory, as determination processing (S10). The control unit 30 determines presence/absence of the drop temperature corresponding to the pattern by referring to the memory. In a case where the drop temperature corresponding to the pattern has not been stored in the memory, the control unit 30 operates in the drop check mode, as operation mode setting processing (S12). The control unit 30 operates in the above-described drop check mode to acquire the drop temperature. Thereafter, the control unit 30 stores the pattern and the drop temperature in the memory or the like of the control unit 30 in association with each other, as storage processing (S14). In a case where the drop temperature corresponding to the pattern has been stored in the memory as a result of the determination processing (S10) or in a case where the storage processing (S14) ends, the flowchart illustrated in FIG. 8 ends.

Performing the flowchart illustrated in FIG. 8 makes it possible to acquire the drop temperature corresponding to the pattern before the pouring processing.

Figure 9:
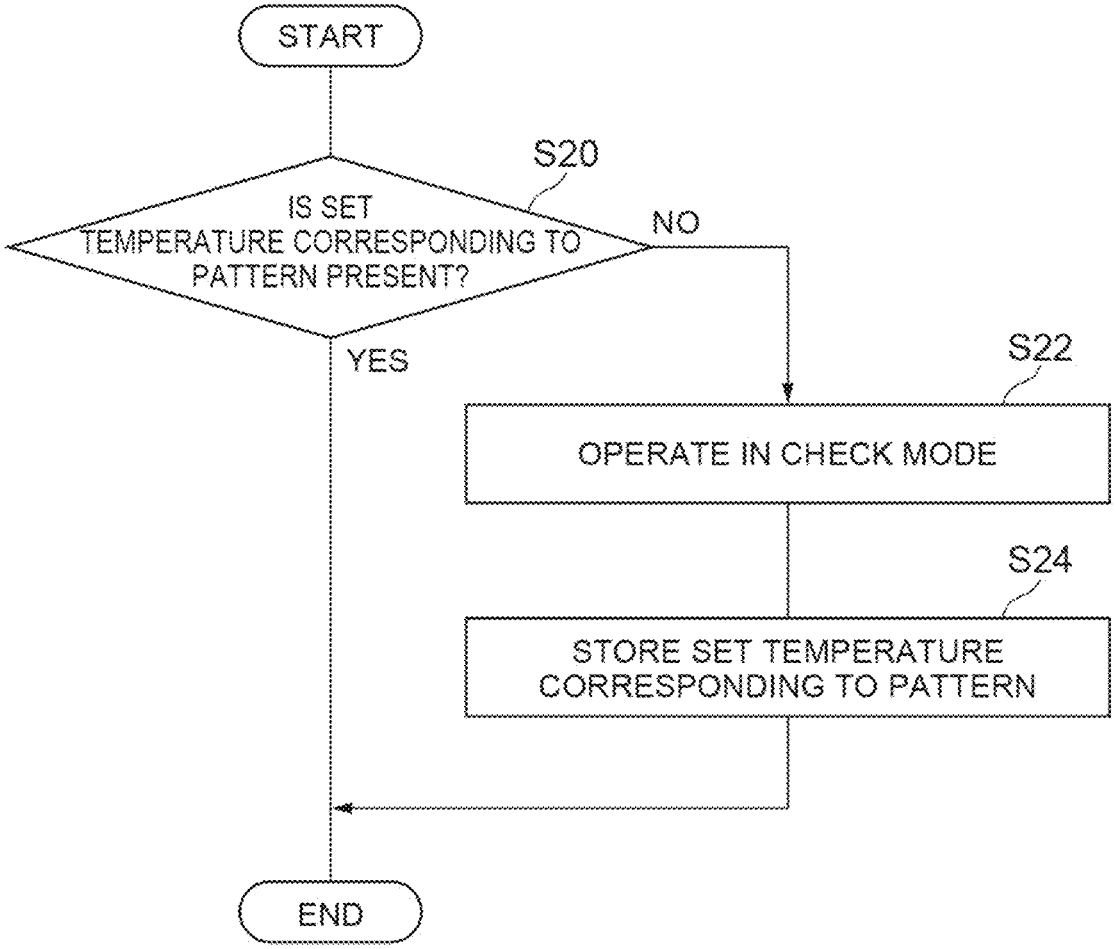
FIG. 9 is a flowchart illustrating an example of the operation of the set temperature determination system according to the exemplary embodiment.

FIG. 9 is a flowchart illustrating an example of the operation of the set temperature determination system according to the exemplary embodiment. The flowchart illustrated in FIG. 9 is performed before the pouring processing starts.

As illustrated in FIG. 9, the control unit 30 determines whether the set temperature corresponding to the pattern has been stored in the memory, as determination processing (step S20). The control unit 30 determines presence/absence of the set temperature corresponding to the pattern by referring to the memory. In a case where the set temperature corresponding to the pattern has not been stored in the memory, the control unit 30 operates in the check mode, as operation mode setting processing (step S22). The control unit 30 operates in the above-described check mode to determine the set temperature. Thereafter, the control unit 30 stores the pattern and the set temperature in the memory or the like of the control unit 30 in association with each other, as storage processing (step S24). In a case where the set temperature corresponding to the pattern has been stored in the memory as a result of the determination processing (step S20) or in a case the storage processing (step S24) ends, the flowchart illustrated in FIG. 9 ends.

Performing the flowchart illustrated in FIG. 9 makes it possible to determine the set temperature corresponding to the pattern before the pouring processing.

Figure 10:
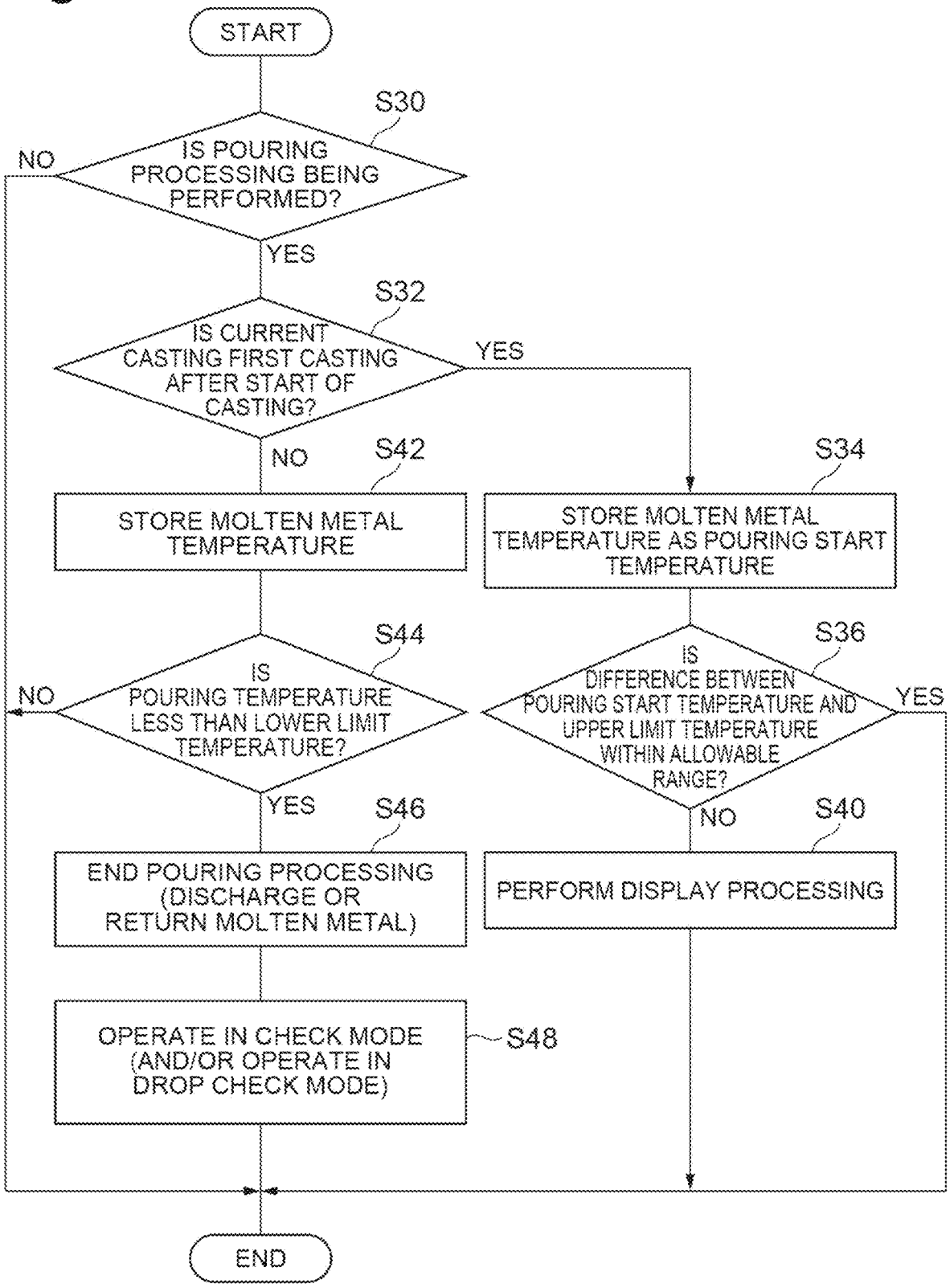
FIG. 10 is a flowchart illustrating an example of the operation of the set temperature determination system according to the exemplary embodiment.

FIG. 10 is a flowchart illustrating an example of the operation of the set temperature determination system according to the exemplary embodiment. The flowchart illustrated in FIG. 10 is repeatedly performed at predetermined timings.

First, the control unit 30 determines whether the pouring processing is being performed (step S30). For example, in a case where an operation signal of the pouring machine 10 has been received, the control unit 30 determines that the pouring processing is being performed. In a case where it is determined that the pouring processing is being performed (step S30: YES), the control unit 30 determines whether the current casting is first casting after start of casting (step S32). The control unit 30 determines whether the current casting is the first casting after start of casting based on, for example, the operation signal of the pouring machine 10. In a case where the current casting is the first casting after start of casting (step S32: YES), the control unit 30 stores the molten metal temperature detected by the second temperature sensor 20 as a pouring start temperature, in the database 60 (step S34).

Subsequently, the control unit 30 determines whether a difference between the pouring start temperature and the upper limit temperature Tu is within an allowable range (step S36). In a case where it is determined that the difference is not within the allowable range (step S36: NO), the control unit 30 displays information about the difference on the display apparatus 50 (step S40). The information about the difference may be a numerical value or magnitude relationship. As a result, abnormality is notified to the worker. If necessary, the worker may cancel the pouring processing and check the drop temperature in the drop check mode. In a case where step S40 ends or in a case where it is determined that the difference is within the allowable range (step S36: YES), the flowchart illustrated in FIG. 10 ends.

Thereafter, the processing starts from the beginning of the flowchart. In a case where second casting has started, the current casting is not the first casting after start of casting (step S32: NO). Therefore, the control unit 30 stores the molten metal temperature detected by the second temperature sensor 20 as the pouring start temperature in the database 60 (step S42).

The control unit 30 determines whether the molten metal temperature stored in step S42 is less than the lower limit temperature Td (step S44). In a case where the molten metal temperature is not less than the lower limit temperature Td (step S44: NO), the flowchart illustrated in FIG. 10 ends, and thereafter, the processing starts from the beginning of the flowchart. In a case where the molten metal temperature is less than the lower limit temperature Td (step S44: YES), the pouring processing ends (step S46). At this time, the molten metal remaining in the pouring ladle LD2 is discharged or returned to the melting furnaces 2. Subsequently, the control unit 30 operates in the check mode and determines the set temperature again (step S48). The control unit 30 may operate in the drop check mode.

In a case where the pouring processing is not being performed in step S30 or in a case where step S48 ends, the flowchart illustrated in FIG. 10 ends.

Summary of Embodiment

In the set temperature determination system 1, the pouring processing for sequentially pouring the molten metal from the pouring ladle LD2 into the plurality of molds MD is performed. When the pouring ladle LD2 becomes empty, next pouring processing for sequentially pouring the molten metal from the next pouring ladle LD2 into the plurality of molds MD is performed. Further, the temperature transition obtained by plotting the molten metal temperature detected by the second temperature sensor 20 for each mold is acquired in each pouring processing. The upper limit temperature Tu is determined such that the percentage of the number of optimum temperature transitions included in the plurality of acquired temperature transitions in the number of the plurality of acquired temperature transitions becomes the predetermined percentage. The optimum temperature transition is a temperature transition falling within the temperature range determined by the upper limit temperature Tu and the predetermined lower limit temperature Td. The temperature obtained by adding the drop temperature that is a temperature dropped during the conveyance processing and the determined upper limit temperature Tu is determined as the set temperature.

In the above-described manner, the set temperature is determined, and the determined set temperature may be adopted as the next set temperature of the molten metal. The upper limit temperature used to determine the set temperature is determined such that the percentage of the number of optimum temperature transitions included in the plurality of temperature transitions in the number of the plurality of temperature transitions becomes the predetermined percentage (for example, 60 percent to 80 percent). Therefore, the set temperature determination system 1 can avoid the set temperature of the molten metal in the melting furnaces 2 from being set higher than necessary. Accordingly, the set temperature determination system 1 can determine the set temperature of the molten metal in consideration of energy efficiency.

Further, the set temperature determination system 1 can contribute to achievement of carbon neutral as global warming countermeasures. For example, when the set temperature of the melting furnaces 2 is lowered by 20° C., reduction of a heat-up time by 70% is expected. A $CO_2$ reduction amount at this time is provisionally calculated. In a case of the melting furnaces 2 of 3000 kW that need the heat-up time of 4 hours per day and operates at a pace of 12 hours per day, a power amount to raise the temperature by 100° C. is 45 kWh, and a value of $CO_2$ converted from the power amount is 0.555 (Kg–$CO_2$/kWh). In this case, about 1.17 ($CO_2$Kg)/h is calculated from ((4 hours×0.7) per day)/(12 hours per day)×45 kWh×(20° C./100° C.)×0.555. In other words, in one pouring machine 10, the $CO_2$ reduction amount of 1.17 Kg per hour is expected. When the number of operation days in one month is assumed to be 22 days, the $CO_2$ reduction amount becomes (1.17 ($CO_2$Kg) per hour)×(12 hours per day)×(22 days per month)×(12 months per year)=3707 Kg per year. In other words, in one pouring machine 10, the $CO_2$ reduction amount of 3707 Kg per year is expected. As described above, the optimum set temperature of the melting furnaces 2 corresponding to the pattern number of the mold MD is instructed to a melting site, which makes it possible to avoid the set temperature of the melting furnaces 2 from being set higher than necessary, and to achieve energy saving. As a result, reduction of the $CO_2$ emission amount is expected, which makes it possible to contribute to carbon neutral.

Although various exemplary embodiments are described above, various omissions, replacements, and changes may be performed without being limited to the above-described exemplary embodiments.

For example, the method of determining the set temperature of the melting furnaces 2 is not limited to the above-described exemplary embodiment. In the above-described exemplary embodiment, the control unit 30 selects the plurality of temperature transitions relating to the same type of pattern among the plurality of temperature transitions, determines the upper limit temperature Tu and the lower limit temperature Td based on the plurality of selected temperature transitions, and determines the set temperature of the melting furnaces 2. The present disclosure is not limited to the method. For example, even in a case where a plurality of types of patterns are present, the control unit 30 may select the temperature transitions relating to a part or all of the patterns, determine the upper limit temperature Tu and the lower limit temperature Td based on the plurality of selected temperature transitions, and determine the set temperature of the melting furnaces 2. In other words, the control unit 30 may determine the upper limit temperature Tu and the lower limit temperature Td common to a part or all of the patterns. As a result, in a case where the patterns are different but a part of all of the patterns has similar relationship, the set temperature determinant system can avoid determination of the set temperature of the melting furnaces 2 for each pattern. This makes it possible to improve efficiency of the processing.

What is claimed is:

1. A system for determining a set temperature of molten metal in a pouring facility, the pouring facility repeating a series of processing including receiving processing for causing a ladle to receive the molten metal generated by a melting furnace generating the molten metal of the set temperature, conveyance processing for conveying the ladle to a pouring machine, and pouring processing for sequentially pouring the molten metal in the ladle into a plurality of molds by the pouring machine, the system comprising:

a temperature sensor configured to detect a molten metal temperature at a nozzle tip of the ladle during the pouring processing; and a control unit configured to acquire a temperature transition obtained by plotting the molten metal temperature detected by the temperature sensor for each mold in each of the pouring processing, the control unit determining the temperature transition falling within a temperature range determined by an upper limit temperature and a predetermined lower limit temperature, as an optimum temperature transition, determining the upper limit temperature to cause a percentage of a number of optimum temperature transitions included in a plurality of acquired temperature transitions in a number of the plurality of acquired temperature transitions to become a predetermined percentage, and determining a temperature obtained by adding a drop temperature that is a temperature dropped during the conveyance processing and the determined upper limit temperature, as the set temperature.

2. The system according to claim 1, wherein the control unit selects, among the temperature transitions of the pouring processing, temperature transitions of the pouring processing using a pattern same as a pattern used in the pouring processing corresponding to the acquired temperature transitions, determines the upper limit temperature to cause the temperature transitions corresponding to the predetermined percentage among the selected temperature transitions of the pouring processing to be the optimum temperature transitions, and determines a temperature obtained by adding the drop temperature and the determined upper limit temperature, as the set temperature corresponding to the pattern.

3. The system according to claim 1, wherein, in a case where the temperature transition includes a molten metal temperature less than the lower limit temperature, the control unit determines the upper limit temperature again.

4. The system according to claim 1, further comprising a display apparatus configured to display information about the melting furnace, wherein in a case where a difference between the molten metal temperature of a first mold included in the acquired temperature transition and the upper limit temperature is not within a preset range, the control unit displays information about the difference on the display apparatus.

5. The system according to claim 1, further comprising a display apparatus configured to display information about the melting furnace, wherein the control unit displays the molten metal temperature of a last mold included in the acquired temperature transition on the display apparatus.

6. A system for determining a set temperature of molten metal in a pouring facility, the pouring facility repeating a series of processing including receiving processing for causing a ladle to receive the molten metal generated by a melting furnace generating the molten metal of the set temperature, conveyance processing for conveying the ladle to a pouring machine, and pouring processing for sequentially pouring the molten metal in the ladle into a plurality of molds by the pouring machine, the system comprising:

a temperature sensor configured to detect a molten metal temperature at a nozzle tip of the ladle during the pouring processing; and a control unit configured to acquire temperature transition obtained by plotting the molten metal temperature detected by the temperature sensor for each mold in each of the pouring processing, and to determine the set temperature, wherein in a case where the temperature transition falling within a temperature range determined by an upper limit temperature and a predetermined lower limit temperature is determined as an optimum temperature transition, the set temperature determined by the control unit satisfies relationship in which a temperature obtained by adding the upper limit temperature and a drop temperature becomes the set temperature, the upper limit temperature being determined to cause a percentage of a number of optimum temperature transitions included in a plurality of acquired temperature transitions in a number of the plurality of acquired temperature transitions to become a predetermined percentage, the drop temperature being a temperature dropped during the conveyance processing.

* * * * *